US007331755B2

(12) United States Patent
Broderick et al.

(10) Patent No.: US 7,331,755 B2
(45) Date of Patent: Feb. 19, 2008

(54) METHOD FOR COATING GAS TURBINE ENGINE COMPONENTS

(75) Inventors: Thomas Froats Broderick, Springboro, OH (US); Ronald Lance Galley, Mason, OH (US); Clifford Earl Shamblen, Cincinnati, OH (US); David Edwin Budinger, Loveland, OH (US); Reed Roy Oliver, Cincinnati, OH (US); Roger Owen Barbe, Cincinnati, OH (US)

(73) Assignee: General Electric Company, Schenectady, NY (US)

( * ) Notice: Subject to any disclaimer, the term of this patent is extended or adjusted under 35 U.S.C. 154(b) by 64 days.

(21) Appl. No.: 10/853,609

(22) Filed: May 25, 2004

(65) Prior Publication Data

US 2005/0265831 A1 Dec. 1, 2005

(51) Int. Cl.
*F01D 9/00* (2006.01)
*B23P 15/04* (2006.01)

(52) U.S. Cl. ..... 415/191; 29/889.22

(58) Field of Classification Search ..... 415/191, 415/209.3; 416/248; 29/889.22; 428/668, 428/679, 680

See application file for complete search history.

(56) References Cited

U.S. PATENT DOCUMENTS

| | | | | |
|---|---|---|---|---|
| 5,232,789 | A | 8/1993 | Platz et al. | |
| 5,268,045 | A | 12/1993 | Clare | |
| 5,356,545 | A | 10/1994 | Wayte | |
| 5,397,649 | A | 3/1995 | Schienle et al. | |
| 5,561,827 | A | 10/1996 | Reeves et al. | |
| 5,628,814 | A | 5/1997 | Reeves et al. | |
| 5,705,281 | A | 1/1998 | Reeves et al. | |
| 5,902,421 | A * | 5/1999 | Christy | 148/528 |
| 6,164,904 | A * | 12/2000 | Abriles et al. | 415/139 |
| 6,435,830 | B1 * | 8/2002 | Allen et al. | 416/193 A |
| 6,451,454 | B1 * | 9/2002 | Hasz et al. | 428/668 |
| 6,527,165 | B1 * | 3/2003 | Budinger et al. | 228/226 |

* cited by examiner

*Primary Examiner*—Edward K. Look
*Assistant Examiner*—Nathan Wiehe
(74) *Attorney, Agent, or Firm*—Willam Scott Andes Armstong Teasdale LLP

(57) ABSTRACT

A method for assembling a vane sector for a gas turbine engine, the vane sector including an airfoil vane and a platform includes depositing a wear coating material onto a selected area of the platform, positioning the platform adjacent to the airfoil vane, and executing a brazing operation such that the airfoil vane is permanently coupled to the platform portion and such that the wear coating material is bonded across a predefined area of the platform.

16 Claims, 4 Drawing Sheets

METHOD FOR COATING GAS TURBINE ENGINE COMPONENTS

BACKGROUND OF THE INVENTION

The invention relates generally to gas turbine engines, and more particularly, to methods for depositing a coating on a selective area of a turbine component.

At least some known gas turbine engines include rotating components which may contact or "rub" adjacent stationary components during normal engine operation. For example, compressor rotor blades are sized such that a tip of the rotor blade "rubs" an adjacent shroud, thus forming a seal between the compressor rotor blade and the shroud.

To facilitate reducing damage to the compressor rotor blades, at least some known gas turbine engine rotor blades are coated with a wear resistant coating material. Such coatings are generally used to facilitate reducing a rate of wear of the blade caused when the blade contacts a surrounding shroud. Other wear coatings may be deposited along a leading edge of the turbine blade to facilitate decreasing wear caused by contact with environmental particulates, e.g., dirt, sand, that enter the turbine engine during operation. Another type of known wear coating is deposited across components of the turbine engine that are susceptible to wear caused by part-to-part contact during operation. For example, in a high pressure turbine (HPT) and/or a low pressure turbine (LPT) section of a gas turbine engine, wear coatings may be deposited on pre-determined areas of vane sectors that may rub against an adjacent structure, such as a shroud hanger or a pressure balance seal.

At least one known method of depositing a wear coating onto a surface of a gas turbine engine vane sector requires machining a plurality of individual components of the vane sector, depositing a coating material onto an outer surface of the machined components, and then brazing the coated components to produce an inseparable gas turbine vane sector that may be installed in the gas turbine engine. However, applying the wear coating prior to brazing the individual components may require several steps. For example, the components must be masked to prevent the wear coating from being deposited on portions of the component that are not subject to part-to-part wear. Accordingly, coating the separate components prior to assembling the final component, may result in additional fabrication costs, and may thereby increase the overall cost of the component.

BRIEF SUMMARY OF THE INVENTION

In one aspect, a method for assembling a vane sector for a gas turbine engine, the vane sector including an airfoil vane and a platform is provided. The method includes depositing a wear coating material onto a selected area of the platform, positioning the platform adjacent to the airfoil vane, and executing a brazing operation such that the airfoil vane is permanently coupled to the platform portion and such that the wear coating material is bonded across a predefined area of the platform.

In a another aspect, a vane sector for a gas turbine engine is provided. The vane sector includes at least one airfoil vane, at least one platform brazed to the airfoil vane, and a wear coating material deposited onto a selected area of the platform, the wear coating is bonded across a predefined area of the platform when the platform is brazed to the airfoil vane.

In a further aspect, a gas turbine engine including a plurality of vane sectors is provided. Each vane sector includes at least one airfoil vane, at least one platform brazed to the airfoil vane, and a wear coating material deposited onto a selected area of the platform, the wear coating is bonded across a predefined area of the platform when the platform is brazed to the airfoil vane.

DETAILED DESCRIPTION OF THE INVENTION

Figure 1:
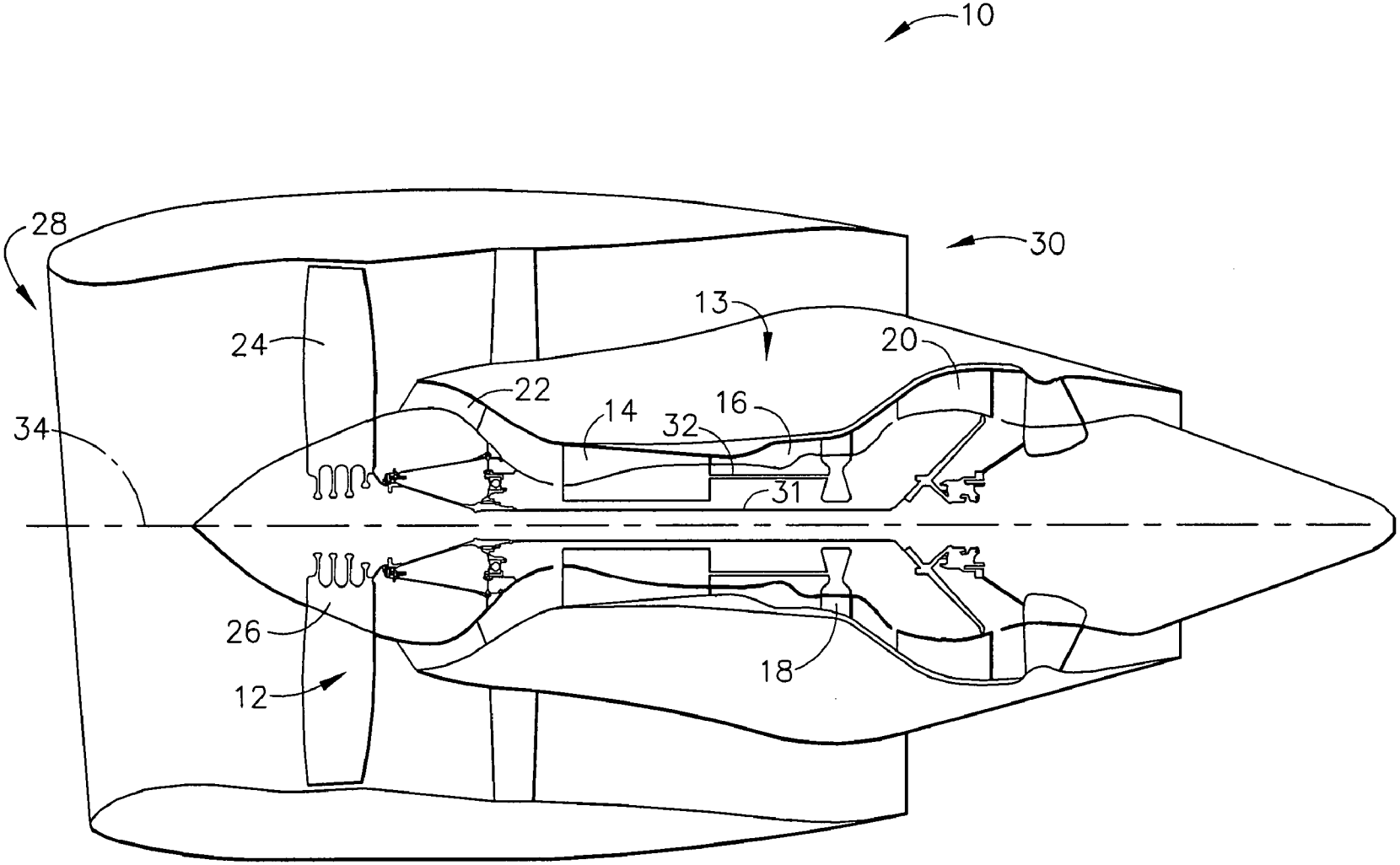
FIG. 1 is a schematic illustration of an exemplary gas turbine engine.

FIG. 1 is a schematic illustration of a gas turbine engine 10 including a fan assembly 12 and a core engine 13 including a high pressure compressor 14, and a combustor 16. Engine 10 also includes a high pressure turbine 18, a low pressure turbine 20, and a booster 22. Fan assembly 12 includes an array of fan blades 24 extending radially outward from a rotor disc 26. Engine 10 has an intake side 28 and an exhaust side 30. In one embodiment, the gas turbine engine is a GE90 available from General Electric Company, Cincinnati, Ohio. Fan assembly 12 and turbine 20 are coupled by a first rotor shaft 31, and compressor 14 and turbine 18 are coupled by a second rotor shaft 32.

During operation, air flows axially through fan assembly 12, in a direction that is substantially parallel to a central axis 34 extending through engine 10, and compressed air is supplied to high pressure compressor 14. The highly compressed air is delivered to combustor 16. Airflow (not shown in FIG. 1) from combustor 16 drives turbines 18 and 20, and turbine 20 drives fan assembly 12 by way of shaft 31.

Figure 2:
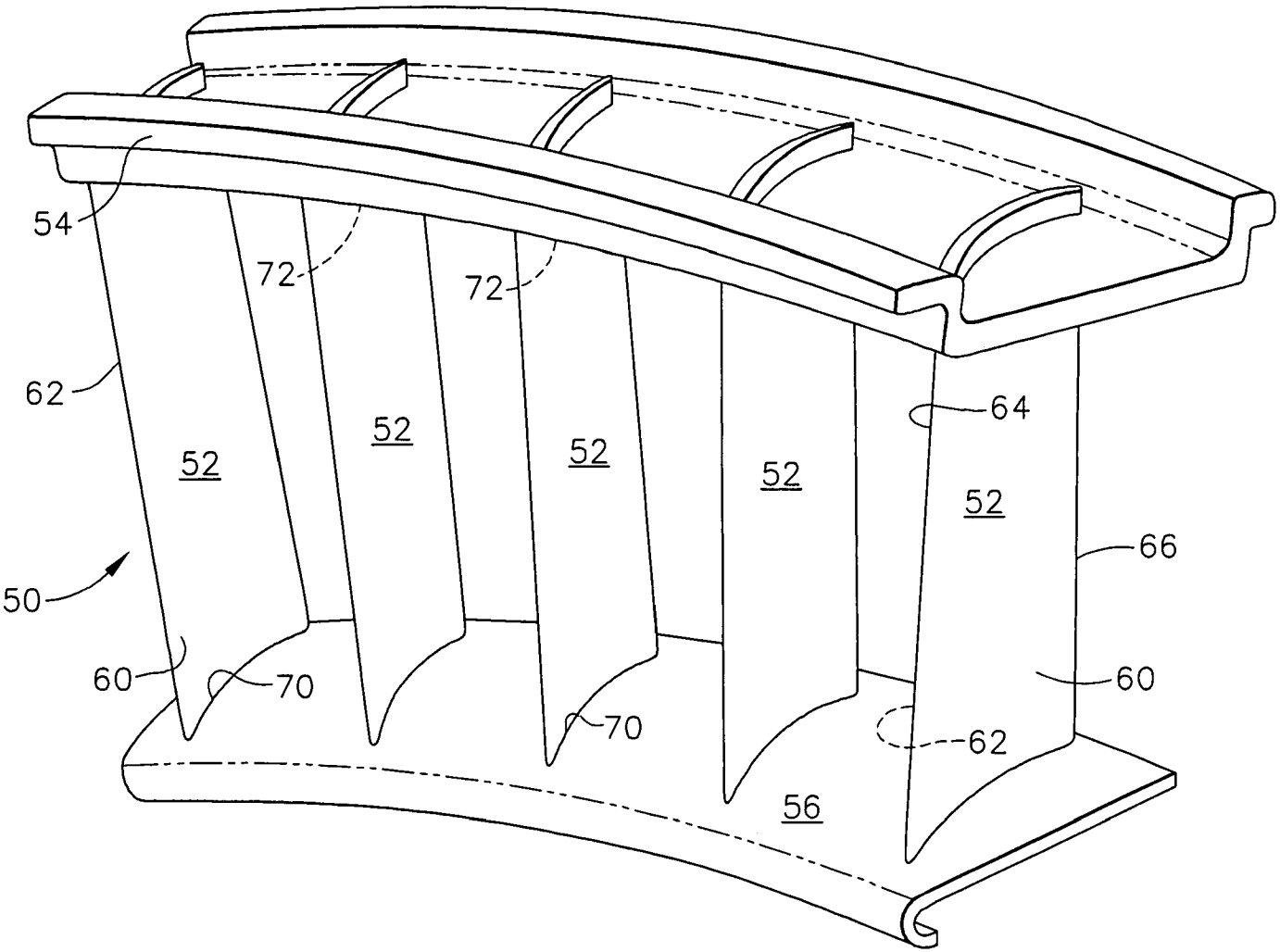
FIG. 2 is a perspective view of a vane sector that may be used with the gas turbine engine shown in FIG. 1.

FIG. 2 is a perspective view of an exemplary gas turbine compressor vane sector 50 that may be used with a gas turbine engine, such as engine 10 (shown in FIG. 1). Vane sector 50 includes a plurality of circumferentially-spaced airfoil vanes 52 coupled between a radially outer band or platform 54 and a radially inner band or platform 56. In the exemplary embodiment, high pressure compressor 14 includes a plurality of stages, and a plurality of vane sectors 50 that are coupled together and circumscribe an outer periphery of each compressor stage. Additionally, although FIG. 2 illustrates vane sector 50 as including five airfoil vanes 52, it should be realized that vane sector 50 may include any quantity of airfoil vanes, for example, two, three, four, etc.

Each airfoil vane 52 includes a first sidewall 60 and a second sidewall 62. First sidewall 60 is concave and defines a pressure side of airfoil vane 52, and second sidewall 62 is convex and defines a suction side of airfoil vane 52. Sidewalls 60 and 62 are joined at a leading edge 64 and at an axially-spaced trailing edge 66 of airfoil vane 52. First and second sidewalls 60 and 62, respectively, extend longitudinally, or radially outwardly, in span from radially inner band 56 to radially outer band 54. An airfoil root 70 is defined as being adjacent to inner band 56, and an airfoil tip 72 is defined as being adjacent to outer band 54.

Figure 3:
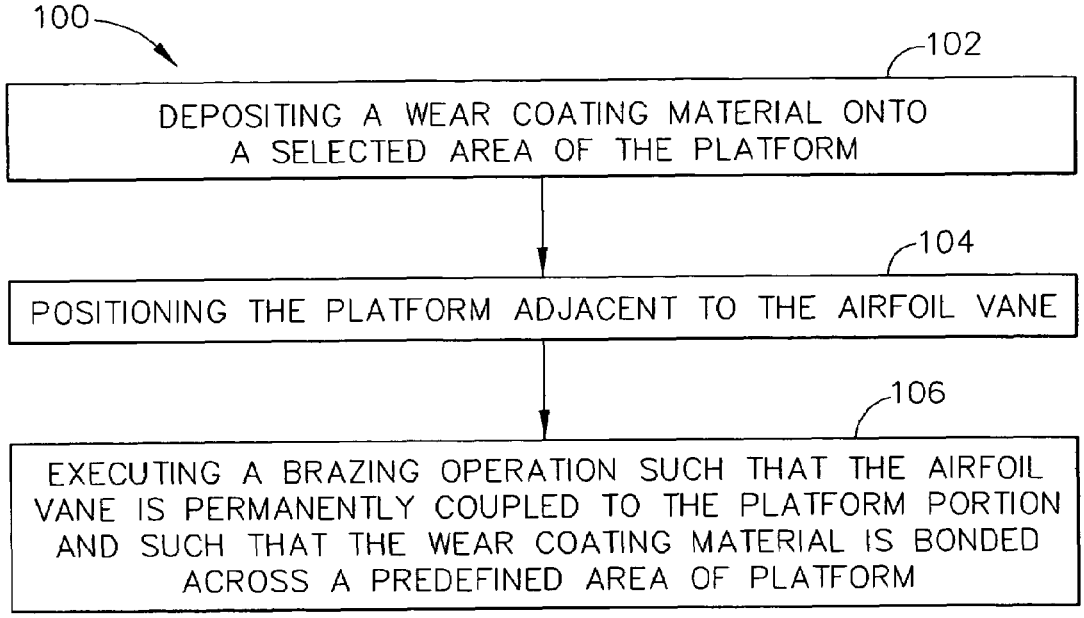
FIG. 3 is an exemplary method that may be used to assemble a vane sector that may be used with the gas turbine engine shown in FIG. 1.
Figure 5:
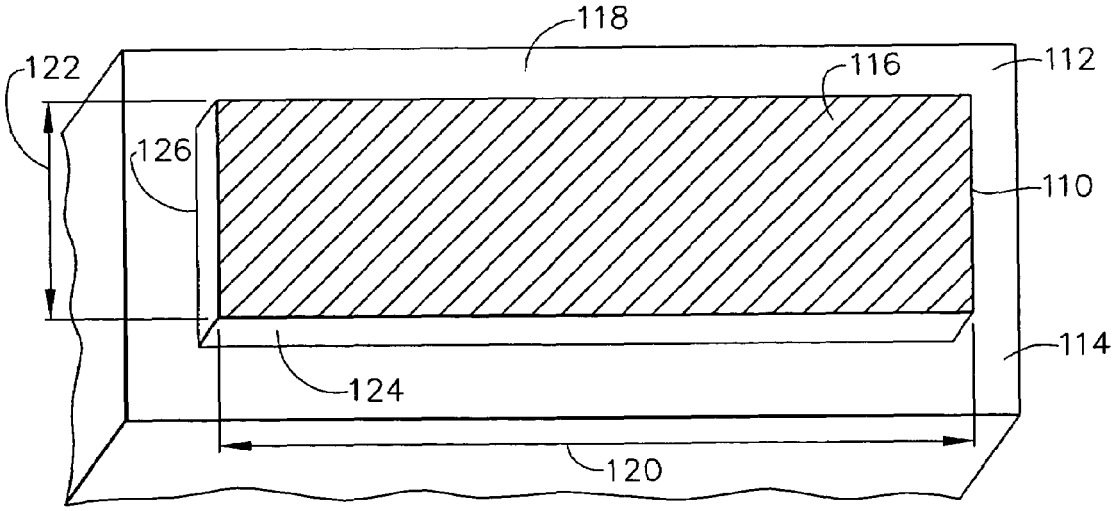
FIG. 5 is a perspective view of a portion of the vane sector shown in FIG. 4.
Figure 4:
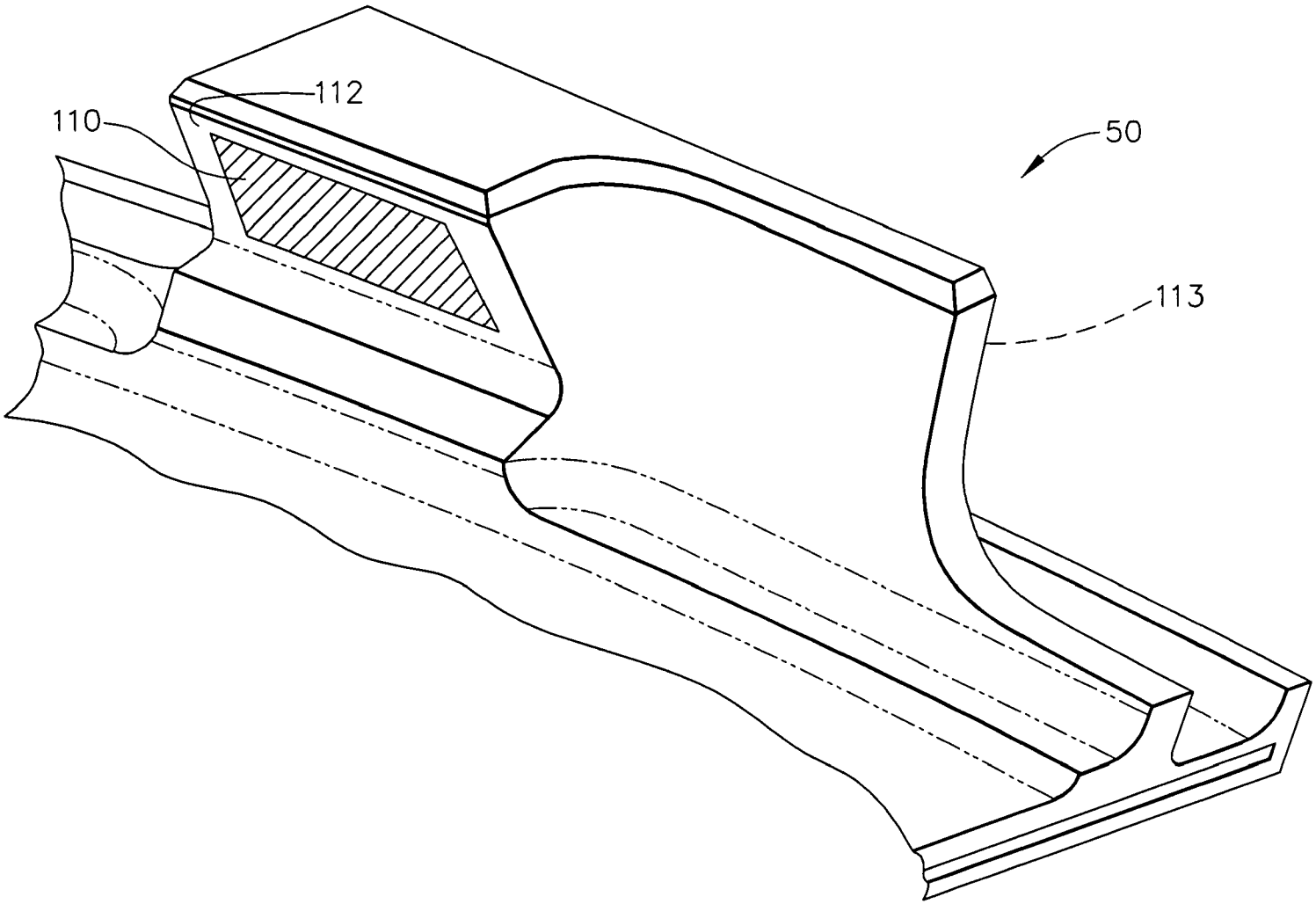
FIG. 4 is a perspective view of a vane sector assembled using the method illustrated in FIG. 3.

FIG. 3 is an exemplary method 100 that may be used to assemble an exemplary vane sector, such as vane sector 50 (shown in FIG. 2), for a gas turbine engine, wherein the vane sector includes at least one airfoil vane and at least one platform. FIG. 4 is a perspective view of an exemplary high pressure compressor (HPC) vane sector 50 that has been assembled using the method illustrated in FIG. 3. FIG. 5 is a perspective view of a portion of the vane sector shown in FIG. 4 and taken along 5-5. Assembly method 100 includes depositing 102 a wear coating material onto a selected area of the platform, positioning 104 the platform adjacent to the airfoil vane, and executing 106 a brazing operation such that the airfoil vane is permanently coupled to the platform portion and such that the wear coating material is bonded, and thus deposited, across a predefined area of the platform. Although the methods herein are described with respect to a vane sector, it should also be appreciated that the methods can be applied to a wide variety of engine components. For example, the engine component may be of any operable shape, size, and configuration such as, but not limited to, a compressor vane sector.

Referring to FIGS. 4 and 5, fabricating an engine component such as vane sector 50, includes applying a wear coating 110 to at least one of rub surface 112 and rub surface 113 while substantially simultaneously brazing airfoil 52 to at least one of platform 54 and 56. In the exemplary embodiment, wear coating 110 is a wear tape which is applied to a rub surface 112 or 113 of vane sector 50. Rub surface, as used herein, is defined as a surface of vane sector 50 which physically contacts, i.e. rubs, a surface of an adjacent structure such as, but not limited to, a compressor case. More specifically, wear coating 110 is applied to an area 114 which represents a particular region for application of wear coating 110. In the exemplary embodiment, wear coating 110 includes a first matrix phase formed of wear material, and a second, matrix phase formed of a bonding alloy that has a liquidous temperature below the bonding temperature and bonds the wear material to a substrate, e.g. rub surface 112 or 113. In one embodiment, wear coating 110 is deposited by placing a length of wear tape 110 at least one of rub surface 112 and rub surface 113 and then fusing wear tape 110 to rub surface 112 or rub surface 113.

In the exemplary embodiment, wear coating 110 is manufactured with a bonding temperature range that is approximately equivalent to the desired temperature range used to braze the desired engine components together. The bonding temperature is also set such that wear coating 110 densifies and does not flow extensively beyond a planned coating area 118. In use, two powders, i.e. a wear material and a bonding alloy, are selected based on performance and then blended together in a predetermined ratio to achieve a high density bonding to the substrate and to facilitate reducing excessive flow. More specifically, the wear material is an aggregate and the bonding material flows around the aggregate.

Wear coating 110 can be applied to the engine component, using the braze-tape process described herein, on any orientation surface of the engine component. More specifically, wear coating 110 can be applied to either rub surface 112 or rub surface 113 even when the rub surfaces are up-side down, i.e. 360 degrees from horizontal, or to a rub surface positioned on a bottom surface of a component, e.g. a bottom surface of platform 56. Wear coating 110 has a length 120, a width 122, and a thickness 124 that are variably selected to ensure that wear coating 110 does not extend beyond planned coating area 118 when wear coating 110 is bonded during the brazing operation.

In operation, wear coating 110 is applied to at least one of rub surface 112 and rub surface 113. In one exemplary embodiment, wear coating 110 is applied to rub surfaces 112, 113 using a preform such as a sintered braze tape for example. In another embodiment, wear coating 110 is applied to rub surfaces 112, 113 using a salt and pepper method. More specifically, the powder is sprayed over a surface and then the adhesive is sprayed over the surface. This technique continues until the desired coating thickness has been applied to rub surfaces 112 or rub surface 113. Suitable adhesives completely volatilize during the brazing step and can include for example, but are not limited to including, a polyethylene oxide and an acrylic material. Adhesive 126 may be applied to rub surfaces 112 or 113 utilizing one of various techniques such as, but not limited to, coating wear coating 110 using a liquid adhesive, or applying a mat or film of double-sided adhesive tape to wear coating 110.

After wear coating 110 is applied to rub surface 112 or 113, a brazing operation is performed to facilitate permanently airfoil vane 52 is permanently coupled to at least one of platform 54 or 56, and such that wear coating material 110 is bonded across a predefined area 118 of the platform substantially simultaneously with the brazing operation. More specifically, wear coating 110 can be applied to rub surfaces 112 or 113, and airfoil vane 52 can be permanently coupled to either platform 54 or 56 during a single brazing operation. The brazing operation is performed using at least one of a vacuum furnace or a protective atmosphere, such as but not limited to, argon and nitrogen for example.

During the brazing operation, wear coating 110 is fused to wear surface 112 or 113 without any substantial attendant melting of the substrate. The brazing temperature is largely dependent upon the type of braze alloy used, but is typically in a range of approximately 950° Celsius (C) to approximately 1260° C.

In one embodiment, brazing is carried out in a furnace including a controlled environment, such as a vacuum or an inert atmosphere. Brazing in a controlled environment advantageously facilitates preventing oxidation of the braze alloy and underlying materials, including the substrate, during heating, and facilitates a more precise control of part temperature and temperature uniformity. Following heating, wear coating 110 is fused to either platform 54 or 56, and the braze alloy is permitted to cool, such that a metallurgical bond is formed against the underlying material thus retaining wear coating 110 against rub surface 112 or 113. In another exemplary embodiment, wear coating 110 is pre-sintered to remove a wear coating binder and increase a density of wear coating 110. Wear coating 110 is then affixed to rub surface 112 or 113 using resistance welding for example.

The methods described herein facilitate applying a wear-coating to rub surfaces of a component during a standard braze fabrication cycle regardless of the angle of the component surface with respect to horizontal. The wear coating can be applied without excessive flow, such that the wear coating remains in the design area while retaining dimensional tolerances allowed for the coating. The methods described herein also facilitate eliminating the requirement for a separate wear resistant coating application step prior to brazing the turbine components.

The above-described methods and systems for applying a wear coating on a selective area of a turbine engine component is cost-effective and highly reliable for facilitating coating a portion of a component where a coating is desired and for facilitating preventing the coating from contacting a portion of the component where a coating is not desired. As a result, the methods and apparatus described herein facilitate fabrication and maintenance of components in a cost-effective and reliable manner.

Exemplary embodiments of combinations of gas turbine engine components and wear coatings are described above in detail. The combinations are not limited to the specific embodiments described herein, but rather, components of each combination may be utilized independently and separately from other components described herein. Each combination component can also be used in combination with other system components.

While the invention has been described in terms of various specific embodiments, those skilled in the art will recognize that the invention can be practiced with modification within the spirit and scope of the claims.

What is claimed is:

1. A method for newly assembling a vane sector for a gas turbine engine, wherein the vane sector includes an airfoil vane and a platform, said method comprising:

defining a brazing area that facilitates coupling the airfoil vane to the platform during a brazing operation;

depositing a wear coating material created by blending a wear material and a bonding alloy together to facilitate high density bonding onto a preselected rub surface of the platform, wherein the rub surface is a distance away from the brazing area and wherein the wear coating material has a bonding temperature selected to facilitate densifying the wear coating material to prevent the wear coating material from flowing beyond the preselected rub surface when the airfoil vane is brazed;

positioning the platform adjacent to the airfoil vane; and executing a brazing operation to couple the airfoil valve to the platform, where the brazing operation is at a brazing temperature approximately equivalent to the material bonding temperature such that the airfoil vane is permanently coupled to the platform portion within the brazing area and such that the wear coating material is bonded across only the preselected rub surface of the platform and is not bonded within the brazing area.

2. A method in accordance with claim 1 wherein depositing a wear coating material comprises applying a wear-tape material onto the preselected rub surface.

3. A method in accordance with claim 2 wherein applying a wear-tape material onto the preselected rub surface comprises applying a wear-tape material including a length, a width, and a thickness that are variably selected to facilitate bonding the wear coating material across the preselected rub surface of the platform.

4. A method in accordance with claim 1 wherein depositing a wear coating material onto a preselected rub surface of the platform further comprises adhesively bonding the wear coating to the preselected rub surface of the platform.

5. A method in accordance with claim 1 further comprising pre-sintering the coating material before performing the brazing operation.

6. A method in accordance with claim 1 further comprising:

depositing the wear coating material onto a selected area defined within a plurality of platforms;

positioning the platforms adjacent to a plurality of airfoil vanes; and executing a single brazing operation to permanently secure each of the plurality of airfoil vanes to the platforms and to bond the wear coating material only across a predefined area of each platform.

7. A newly manufactured vane sector for a gas turbine engine, said vane sector comprising:

at least one airfoil vane;

at least one platform brazed to said airfoil vane during a brazing operation, wherein said at least one airfoil vane is only coupled to said at least one platform within a defined brazing area; and a wear-tape material including a wear coating material deposited onto a preselected rub surface of said platform, said wear coating material comprising a wear material and a bonding alloy blended together to have a bonding temperature selected to facilitate densifying said wear coating material to prevent said wear coating material from flowing beyond said preselected rub surface during the brazing operation, said bonding temperature approximately equivalent to a brazing temperature of said at least one airfoil vane, wherein the said rub surface is a distance away from the said brazing area, said wear coating is bonded across only the said preselected rub surface of said platform and is not bonded within the said brazing area when said platform is brazed to said airfoil vane.

8. A vane sector in accordance with claim 7 wherein said wear coating material comprises a wear-tape material.

9. A vane sector in accordance with claim 8 wherein said wear-tape material comprises a length, a width, and a thickness that are variably selected based on a planned coating area size.

10. A vane sector in accordance with claim 7 wherein said wear coating material is adhesively bonded to a surface of said platform.

11. A vane sector in accordance with claim 7 wherein said wear coating material is pre-sintered prior to depositing said wear coating material.

12. A vane sector in accordance with claim 7 wherein said platform comprises a planned coating area, and said coating material is brazed to said platform at a pre-selected temperature such that said wear coating does not flow extensively beyond said planned coating area.

13. A vane sector in accordance with claim 7 wherein said vane sector comprises:

a plurality of airfoil vanes;

a plurality of platforms brazed to said plurality of airfoil vanes within a defined brazing area that facilitates coupling said plurality of airfoil vanes to said plurality of platforms during a brazing operation; and a wear coating material deposited onto a preselected area of each said platform, said wear coating is bonded across the preselected area of each said platform when each said platform is brazed to said airfoil vanes.

14. A gas turbine engine comprising:

a plurality of newly manufactured vane sectors, each said vane sector comprising:

at least one airfoil vane;

at least one platform brazed to said airfoil vane during a brazing operation, wherein the platform is only coupled to the vane within a defined brazing area; and a wear-tape material including a wear coating material deposited onto a preselected rub surface of said platform, said wear coating material comprising a wear material and a bonding alloy blended together to have a bonding temperature selected to facilitate densifying said wear coating material to prevent said wear coating material from flowing beyond said preselected rub surface during the brazing operation, said bonding temperature approximately equivalent to a brazing temperature of said at least one airfoil vane, wherein the rub surface is a distance away from the brazing area, said wear coating is bonded across the said preselected rub surface of said platform and is not bonded within the said brazing area when said platform is brazed to said airfoil vane.

15. A gas turbine engine in accordance with claim 14 wherein said wear coating comprises a wear-tape material.

16. A gas turbine engine in accordance with claim 15 wherein said wear-tape material comprises a length, a width, and a thickness that are variably selected based on a planned coating area size.

* * * * *